United States Patent [19]

Wallner et al.

[11] Patent Number: 4,651,656

[45] Date of Patent: Mar. 24, 1987

[54] METHOD FOR PROCESSING A HEAVY-METAL-CONTAINING RESIDUE FROM THE CHEMICAL INDUSTRY

[75] Inventors: Felix Wallner; Adam Krier; Walter Lugscheider; Gotthard Uckert, all of Linz; Paul Freimann, Traun, all of Austria

[73] Assignee: Voest-Alpine Aktiengesellschaft, Linz, Austria

[21] Appl. No.: 666,566

[22] Filed: Oct. 30, 1984

[30] Foreign Application Priority Data

Nov. 14, 1983 [AT] Austria ..... 3997/83
Sep. 24, 1984 [AT] Austria ..... 3021/84

[51] Int. Cl.[4] ..... F23G 7/00
[52] U.S. Cl. ..... 110/346; 210/769
[58] Field of Search ..... 210/663–669, 210/688, 737, 751, 766, 773, 774, 806, 769, 770, 771; 110/346; 431/2, 7; 55/97

[56] References Cited

U.S. PATENT DOCUMENTS 3,902,435 9/1975 Schuster ..... 110/346
3,929,586 12/1975 Slikkers ..... 210/751
4,015,997 4/1977 Selmeczi et al. ..... 210/751
4,226,630 10/1980 Styron ..... 210/751
4,356,030 10/1982 Halpin et al. ..... 75/21

FOREIGN PATENT DOCUMENTS 1592392 7/1981 United Kingdom .

*Primary Examiner*—Ivars Cintins
*Attorney, Agent, or Firm*—Brumbaugh, Graves, Donohue & Raymond

[57] ABSTRACT

There is disclosed a method for processing heavy-metal-containing residues from the chemical industry. For an economical and at the same time ecologically safe processing of the heavy-metal-containing residues, the heavy-metal-containing residues are introduced into a primary-gas reaction zone of a shaft gasifier containing at least one solid bed of carbon-containing material. Slag-forming substances are introduced together with the charge substances and/or together with the solid-bed formers to absorb and set the heavy metals. The lower zone of the solid bed is maintained at a temperature above the slag and ash melting temperatures. The viscosity of the slag is less than 100 poise.

14 Claims, 2 Drawing Figures

METHOD FOR PROCESSING A HEAVY-METAL-CONTAINING RESIDUE FROM THE CHEMICAL INDUSTRY

BACKGROUND OF THE INVENTION

The invention relates to a method for processing heavy-metal-containing residues from the chemical industry, in particular hydrogenation residues.

A problem of the chemical industry, in particular of the petrochemical industry, is the ecologically safe processing or reutilization of heavy-metal-containing residues as they occur, for instance, when refining heavy oil and at the hydrogenation of heavy oil. A similar problem arises when processing used oil.

It is known to burn such residues in a power plant, wherein, however, the heavy metals obtained, which are exhausted with the smoke gases and the ashes, constitute a burden on the environment. Unacceptably high portions of heavy metal occur in the flue gases and in the waste waters.

SUMMARY OF THE INVENTION

The invention has as its object to provide an economical and at the same time ecologically safe method for processing heavy-metal-containing residues, by which the heavy metals are converted into water-in-soluble dumpable form and the thermal content of the residues simultaneously is rendered available as a source of energy.

According to the invention, this object is achieved in that the heavy-metal-containing residues are introduced into a primary-gas reaction zone of a shaft gasifier containing at least one solid bed of carbon-containing material, that, together with the charge substances, i.e., the heavy-metal-containing residues, and/or together with the material forming the solid-bed, slag-forming substances are introduced to absorb and set the heavy metals, and that the lower zone of the solid bed is maintained at a temperature above the slag and ash melting temperatures, the viscosity of the slag being less than 100 poise.

Shaft gasifiers for carrying out the method are known. Such gasifiers comprise a vertical shaft, which constitutes the secondary-gas reaction zone, and an approximately horizontal chamber communicating with the lower end of the shaft, which constitutes the primary-gas reaction zone. A burner for gasifying the heavy-metal-containing residues communicates with the primary gas reaction zone of the gasifier. The carbon-containing charge, which is introduced into the secondary-gas reaction zone, forms in the primary-gas reaction zone, a conical pile having a free surface and having its base in the slag bath. During the gasification of the residues, the heavy metals, to a major extent, are melted into the slag and are discharged from the shaft gasifier commonly with the slag. The slag gathering in the shaft gasifier is chilled with water as it is discharged, with water, to provide a glassily solidified granulate containing the noxious heavy-metal components. It has been found that be cause of the glassy structure of the solidified slag, the latter can be dumped without any risk to the environment since leaching of heavy-metal compounds does not occur.

For processing vanadium-containing residues, basic slag formers, in particular CaO-containing substances, suitably are additionally introduced into the secondary-gas reaction zone.

For processing ferrous residues, coke, in particular metallurgical coke, advantageously is introduced into the secondary-gas reaction zone and an acidic slag containing at least 40% $SiO_2$ is formed.

In order to minimize discharge of heavy metals with the crude gas resulting from gasification, suitably one or more of the following measures for lowering the formation of soot in the primary-gas reaction zone are applied:

(a) Supply of an oxygen-containing gas in order to achieve a $C/O_2$ ratio, equal to $\lambda$, of at least 0.45 to 0.8, preferably 0.6;

(b) adjustment of a hydrogen/oxygen ratio of at least 0.35 to 0.7, preferably 0.5;

(c) adjustment of the dwell time of the primary gas in the primary-gas reaction zone of from 0.2 to 1.5 s, preferably 0.4 to 0.6 s, and (d) adjustment of the dwell time of the secondary gas in the secondary-gas reaction zone of from 1 to 6 s, preferably 2 to 3 s.

Advantageously, the slag-forming additives, such as limestone, are used at a granulation size of up to 20 mm.

According to a preferred embodiment, the product gas leaving the shaft gasifier is filtered and the filtered dust is supplied to the primary-gas reaction zone. By this measure substantially are of the heavy metals are substantially entirely separated with the slag, an extremely low percentage building up up in the refractory lining of the shaft gasifier.

The invention, furthermore, is concerned with the utilization of sewage sludge. The sewage sludge obtained in the process of clarification of waste waters, depending on its origin, often also contains noxious matter, in particular heavy metals, which restrict the utilization or processing of sewage sludge. Indeed, heavy-metal-containing sewage sludge cannot be used as fertilizer, because undesired heavy-metal contaminations of food may occur. Furthermore, the heavy-metal-containing sewage sludge is not readily pyrolyzable or combustible into ash, because the heavy metals are contained in the flue gases and in the ash in water-soluble form, thus constituting a risk to the environment.

The invention has as its further object to render the thermal content of sewage sludge utilizable as an energy source, with the noxious matter possibly contained in the sewage sludge, in particular heavy metals, converted into water-insoluble dumpable form.

This object is achieved in that, in addition to the aforementioned heavy-metal-containing residues, sewage sludge is supplied to the primary-gas reaction zone as charge substance, the sewage sludge suitably being supplied in an amount of up to 30% of the amount of heavy-metal-containing residues.

Preferably, the sewage sludge is mixed with the heavy-metal-containing residue prior to the feeding thereof.

It is advantageous, if the sewage sludge is dried to a residual moisture of 50 to 60% at most, prior to its feeding.

BRIEF DESCRIPTION OF THE DRAWINGS

The invention is going to be explained in more detail by way of the drawings, in which.

DETAILED DESCRIPTION OF EXEMPLARY EMBODIMENTS

Figure 1:
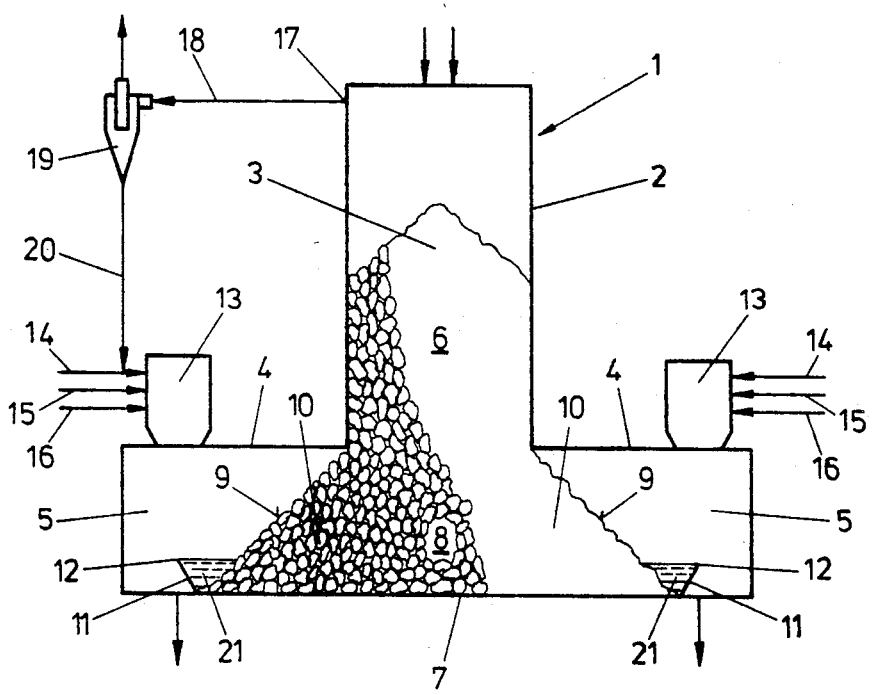
FIGS. 1 and 2 are respectively schematic illustrations of shaft gasifiers according to different embodiments of the invention, as will as by way of two examples.

The shaft gasifier 1 comprises a vertical upper section 2 constituting the secondary-gas reaction zone 3, and at least one (two in the embodiment illustrated) laterally angled lower section 4 constituting the primary-gas reaction zone 5. Into the upper section, the lumpy carbon-containing shaft charge 6, such as, e.g., coke or coal, if desired commonly with separate slag-forming substances, is charged from above via a sluice (not illustrated). The lumpy charge forms a solid bed 8 on the bottom 7 of the shaft gasifier 1, with dumping cones 10 projecting into the primary-gas reaction zones 5 and each having an exposed surface 9. These dumping cones 10 each enter into a slag tub 11 having an overflow weir 12.

On each of the laterally angled lower sections 4, at least one burner 13 is arranged, which, preferably, is designed as a cyclone burner and to which the residue 14 to be utilized is supplied as fuel or in addition to fuel. In addition, steam 15 and oxygen 16 are passed into the primary-gas reaction zone 5 via the burner 13.

The product gas 18 leaving the upper part of the secondary-gas reaction zone 3 through the gas outlet 17 is conducted to a dry separator or a wet scrubber 19. The dust portions 20 separated from the gas are supplied back to the shaft gasifier 1 via one of the burners.

The method according to the invention will now be explained by way of two examples:

EXAMPLE 1

A heavy-metal-containing residue 14 (vacuum residue) from heavy-oil processing was supplied to the burner 13 in an amount of 300 kg/h and with a temperature of 200° C. This residue had the following analysis (in % by weight):

| C | H | O | N | S | $H_2O$ | ash | V |
|---|---|---|---|---|---|---|---|
| 85.6 | 10.5 | 0.09 | 0.55 | 3.05 | 0.1 | 0.11 | 560 ppm |

Furthermore, steam 15 at 18 bar was fed to the burner 13 in an amount of 160 kg/h, which steam had been overheated to 240° C. Oxygen 16 was injected with a temperature of 70° C. and in an amount of 380 $m^3$/h under normal conditions (purity 99.9%, balance N).

In the secondary-gas reaction zone 3, metallurgical coke in an amount of 137 kg/h with a temperature of 20° C. was used as charge substance 6 and as slag former. Sieve analysis of the metallurgical coke (in %);

| >40 mm | 40–20 mm | 20–10 mm | <10 mm |
|---|---|---|---|
| 15.2 | 82.6 | 0.9 | 1.3 |

Chemical analysis of the metallurgical coke (% by weight):

| C | H | O | N | S | $H_2O$ | ash |
|---|---|---|---|---|---|---|
| 82.68 | 0.22 | 0.28 | 0.62 | 0.53 | 4.5 | 11.17 with 600 ppm V |

The primary gas forming in the primary-gas reaction zone had a temperature of 1770° C. and was obtained in an amount of 1099 $m^3$/h under normal conditions (wet). Its dwell time in the primary-gas reaction zone was 0.3 seconds. It had the following chemical composition (calculated as free of N) (% by weight):

| $CO_2$ | $H_2$ | CO | $CH_4$ | (COS + $H_2S$) |
|---|---|---|---|---|
| 22.2 | 26.1 | 50.7 | 0.0 | 1.0 |

The product gas 18 (crude gas or secondary gas) leaving the secondary-gas reaction zone 3 was obtained in a gas amount of 1322 $m^3$/h under normal conditions (wet). The gas temperature was 831° C., the dwell time in the secondary gasification zone was 2 seconds. Its chemical composition (calculated as free of N) was the following (% by weight):

| $CO_2$ | $H_2$ | CO | $CH_4$ | (COS + $H_2S$) |
|---|---|---|---|---|
| 15.5 | 37.0 | 46.9 | 0.0 | 0.6 |

The slag 21 obtained with a temperature of 1500° C. and a viscosity of 80 poise, which ran over the overflow weir 12, flowing out of the primary-gas reaction zone 5, was granulated by means of water under pressure. In the slag, the ash portions of the carbon-containing charge and of the heavy-metal-containing residue are melted in so that the heavy metals that are contained in the ash also are obtained in the slag. The slag solidified in a glassy manner and was obtained in an amount of 15.3 kg/h.

Sieve analysis of the slag:

| >20 mm | 20–10 mm | 10–5 mm | 5–3 mm |
|---|---|---|---|
| 0.0 | 0.1 | 1.2 | 5.8 |
| 3–2 mm | 2–1 mm | 1–0.5 mm | <0.5 mm |
| 11.2 | 30.2 | 32.4 | 19.1 |

Chemical analysis of the slag (% by weight):

| $Al_2O_3$ | $Fe_2O_3$ | FeO | Fe | $SiO_2$ | CaO | MgO |
|---|---|---|---|---|---|---|
| 25.0 | not detectable | 7.1 | 0.1 | 46.0 | 9.4 | 3.2 |
| $C_{tot.}$ | $S_{tot.}$ | $TiO_2$ | $Na_2O$ | $K_2O$ | $P_2O_5$ | V |
| 0.15 | 0.08 | 1.1 | 0.8 | 1.6 | 0.5 | 0.82 |

The dust 20 separated off the crude gas 18, which was obtained in an amount of 2.49 g/$m^3$ under normal conditions, had an ash content of 11.8%, with 12.4% by weight of V being present in the ash.

Hence follows that the amount of vanadium (177.18 g/h) charged into the shaft gasifier 1, i.e. into its primary-gas reaction zone 5 and secondary-gas reaction zone 3, recurred in the slag in an amount of 125.46 g/h, while in the dust of the crude gas no more than 48.17 g/h were contained. The remainder was found as enrichment in the refractory lining of the shaft furnace.

With this balance of vanadium it has not been taken into account that the dust, after having left the shaft gasifier 1, is supplied to the primary-gas reaction zone 5, by which measure almost all of the vanadium is present in the slag in the melted state. In an attempt to leach the solifified slag with $H_2O$, no V could be detected in the $H_2O$.

EXAMPLE 2

A heavy-metal-containing residue 14 (vacuum residue) from heavy-oil processing was supplied to the burner 13 in an amount of 300 kg/h and with a temperature of 200° C. This residue had the following analysis (in % by weight):

| C | H | O | N | S | $H_2O$ | ash | V |
|---|---|---|---|---|---|---|---|
| 85.6 | 10.5 | 0.09 | 0.55 | 3.05 | 0.1 | 0.11 | 560 ppm |

Furthermore, steam 15 at 18 bar was supplied to the burner 13 in an amount of 198 kg/h, which steam had been overheated to 240° C. Oxygen 16 was injected at a temperature of 70° C. and in an amount of 396 $m^3/h$ under normal conditions (purity 99.9%, balance N).

Into the secondary-gas reaction zone 3, metallurgical coke was used as charge, in an amount of 130 kg/h with a temperature of 20° C.

Sieve analysis of the metallurgical coke (in %):

| >40 mm | 40–20 mm | 20–10 mm | <10 mm |
|---|---|---|---|
| 15.2 | 82.6 | 0.9 | 1.3 |

Chemical analysis of the metallurgical coke (% by weight):

| C | H | O | N | S | $H_2O$ | ash |
|---|---|---|---|---|---|---|
| 82.68 | 0.22 | 0.28 | 0.62 | 0.53 | 4.5 | 11.17 with 600 ppm V |

For the increased formation of basic slag, limestone was introduced commonly with the metallurgical coke, in an amount of 13 kg/h and with a temperature of 20° C.

Chemical analysis of the limestone:

| MgO | CaO | others |
|---|---|---|
| 0.7% | 59.0% | 0.3% |

The primary gas forming in the primary-gas reaction zone had a temperature of 1839° C. and was obtained in an amount of 1152 $m^3/h$ under normal conditions (wet). Its dwell time in the primary-gas reaction zone was 0.28 seconds. It had the following chemical composition (calculated as free of N) (% by weight):

| $CO_2$ | $H_2$ | CO | $CH_4$ | (COS + $H_2S$) |
|---|---|---|---|---|
| 25.1 | 24.9 | 49.0 | 0.0 | 1.0 |

The product gas 18 (crude gas or secondary gas) leaving the secondary-gas reaction zone 3 was obtained in a gas amount of 1364 $m^3/h$ under normal conditions (wet). The gas temperature was 864° C., the dwell time in the secondary gasification zone was 1.9 seconds. Its chemical composition (calculated as free of N) was as follows (% by weight):

| $CO_2$ | $H_2$ | CO | $CH_4$ | (COS + $H_2S$) |
|---|---|---|---|---|
| 18.7 | 36.9 | 43.8 | 0.0 | 0.6 |

The slag 21 obtained with a temperature of 1300° C. and a viscosity of 30 poise, which ran over the overflow weir 12, flowing out of the primary-gas reaction zone, was granulated by means of water under pressure. The slag solidified in a glassy manner and was obtained in an amount of 22.3 kg/h.

Sieve analysis of the slag:

| >20 mm | 20–10 mm | 10–5 mm | 5–3 mm |
|---|---|---|---|
| 0.0 | 0.1 | 1.2 | 5.8 |
| 3–2 mm | 2–1 mm | 1–0.5 mm | <0.5 mm |
| 11.2 | 30.2 | 32.4 | 19.1 |

Chemical analysis of the slag (% by weight):

| $AL_2O_3$ | $Fe_2O_3$ | FeO | Fe | $SiO_2$ | CaO | MgO |
|---|---|---|---|---|---|---|
| 16.0 | not detectable | 4.6 | 0.06 | 29.4 | 40.2 | 2.6 |
| $C_{tot.}$ | $S_{tot.}$ | $TiO_2$ | $Na_2O$ | $K_2O$ | $P_2O_5$ | V |
| 0.2 | not determined | | | | | 0.7 |

The dust 20 separated off the crude gas 18, which was obtained in an amount of 0.58 $g/m^3$ under normal conditions, had an ash content of 14.8% with 13.6% by weight of V being present in the ash.

Hence follows that the amount of vanadium (176.7 g/h) charged into the shaft gasifier 1, i.e. into its primary-gas reaction zone 5 and secondary-gas reaction zone 3, recurred in the slag in an amount of 156.24 g/h, while in the dust of the crude gas no more than 15.92 g/h were contained. The remainder was found as enrichment in the refractory lining of the shaft furnace. As in Example 1, it has not been taken into account with this balance of vanadium that the dust, after having left the shaft gasifier 1, is supplied to the primary-gas reaction zone 5, by which measure almost all of the vanadium is present in the slag in the melted state. In an attempt to leach the solidified slag with $H_2O$, no V could be detected in the $H_2O$.

By the method according to the invention it is possible to melt V, Fe, Ni, Cr and other heavy metals almost completely into the slag. It is of a particular advantage to prevent the formation of soot in the primary-gas reaction zone, because soot absorbs heavy metals.

Figure 2:
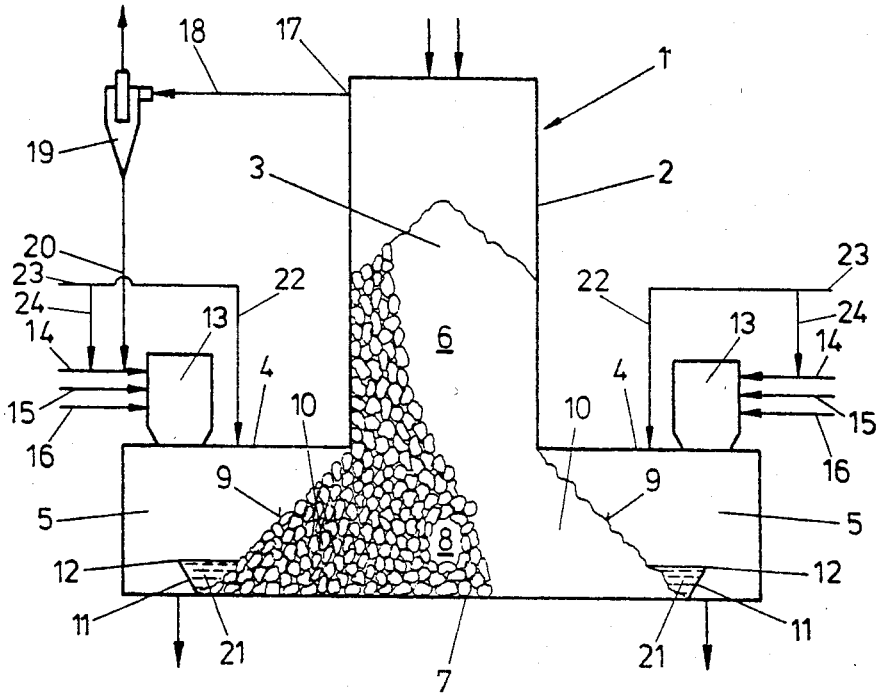

As is apparent from FIG. 2, according to a further exemplary embodiment, a supply duct 22 enters into the primary-gas reaction zone 5, through which sewage sludge 23 with a residual moisture of at most 50 to 60% is fed. The sewage sludge 23 can can also be mixed with the residues 14 to be utilized prior to the feeding of the same, through a branch duct 24 entering into the duct feeding the residues 14 to be utilized.

The sewage sludge 23 is introduced into the primary-gas reaction zone 5 preferably in an amount of up to 30% of the amount of the residues 14 to be utilized.

The ash portions of the carbon-containing charge, of the heavy-metal-containing residue and of the sewage sludge have been melted into the glassily solidified slag, and thus are dumpable without any risk to the environment.

What we claim is:

1. A method for processing the combustible residue of a chemical process, which residue contains heavy metal components, in a shaft gasifier having a primary-gas reaction zone and a secondary-gas reaction zone, said method comprising the steps of forming a solid bed of carbon-containing material in the primary-gas reaction zone of said gasifier, introducing charging substances including an oxygen bearing gas and said heavy-metal-containing residue into said primary-gas reaction zone, introducing into said gasifier slag-forming substances for absorbing and setting the heavy metals contained in said residue, burning said oxygen bearing gas and heavy metal containing residue to produce a primary gas in said primary-gas reaction zone and a secondary gas in said secondary-gas reaction zone, and maintaining a temperature in said solid bed at a level to produce slag and ash from said charging and slag-forming substances and above the melting point of said slag and ash, and to keep the viscosity of said slag below 100 poise.

2. A method as set forth in claim 1, wherein said slag-forming substances are introduced into said gasifier with at least one of said charging substances and said carbon-containing material forming said solid bed.

3. A method as set forth in claim 1 wherein the residue contains vanadium and said slag-forming substances are basic.

4. A method as set forth in claim 3, wherein said basic slag-forming substances are CaO-containing substances.

5. A method as set forth in claim 1 wherein the residue is ferrous and coke is introduced into said secondary-gas reaction zone to provide the carbon-containing material for the solid bed and to form an acidic slag comprising at least 40% of $SiO_2$.

6. A method as set forth in claim 5, wherein said coke is comprised of metallurgical coke.

7. A method as set forth in claim 1, further comprising the step of reducing the formation of soot in said primary-gas reaction zone by applying at least one of the following measures:

(a) supplying the oxygen-containing gas to said primary reaction zone so as to obtain a $C/O_2$ ratio of at least 0.45 to 0.8;

(b) maintaining the hydrogen/oxygen ratio in said primary-reaction zone at at least 0.35 to 0.7;

(c) maintaining the dwell time for the primary gas in said primary-gas reaction zone between 0.2 to 1.5 seconds; and (d) maintaining the dwell time for the secondary gas in said secondary-gas reaction zone between 1 to 6 seconds.

8. A method as set forth in claim 7, wherein said $C/O_2$ ratio is 0.6, said hydrogen/oxygen ratio is 0.5, and primary gas dwell time is 0.4 to 0.6 seconds, and said secondary-gas dwell time is 2 to 3 seconds.

9. A method as set forth in claim 1 wherein said slag-forming substances are granular and of a granulation size of 20 mm.

10. A method as set forth in claim 1, wherein product gas is produced in and leaves said shaft gasifier, and which further comprises filtering said product gas so as to obtain filtered-off dust, and supplying said filtered-off dust to said primary-gas reaction zone.

11. A method as set forth in claim 1, wherein sewage sludge is supplied to said primary-gas reaction zone as charging substance in addition to said heavy-metal-containing residue.

12. A method as set forth in claim 11, wherein said sewage sludge is supplied in an amount of up to 30% of the amount of said heavy-metal residue.

13. A method as set forth in claim 11, wherein said sewage sludge is mixed with said heavy-metal residue prior to being supplied to said primary-gas reaction zone.

14. A method as set forth in claim 11, further comprising the step of drying said sewage sludge to a maximum residual moisture of 50 to 60% prior to being supplied to said primary-gas reaction zone.

* * * * *

UNITED STATES PATENT AND TRADEMARK OFFICE

CERTIFICATE OF CORRECTION

PATENT NO. : 4,651,656

DATED : Mar. 24, 1987

INVENTOR(S) : Wallner et al.

It is certified that error appears in the above-identified patent and that said Letters Patent is hereby corrected as shown below:

Col. 1, line 63, "be cause" should read --because--.

Col. 2, line 28, after "substantially", "are" should read --all--
line 68, "will" should read --well--.

Col. 4, line 67, "solifified" should read --solidified--.

Signed and Sealed this

Twenty-fifth Day of August, 1987

*Attest:*

DONALD J. QUIGG

*Attesting Officer*

*Commissioner of Patents and Trademarks*